US012435721B2

(12) United States Patent
Oberhausen et al.

(10) Patent No.: US 12,435,721 B2
(45) Date of Patent: Oct. 7, 2025

(54) DRIVE SYSTEM FOR A MULTI-STAGE SCREW COMPRESSOR

(71) Applicant: COMPAIR DRUCKLUFTTECHNIK—ZWEIGNIEDERLASSUNG DER Gardner Denver Deutschland GMBH, Simmern (DE)

(72) Inventors: Rainer Oberhausen, Simmern (DE); Michael Federmann, Bell (DE)

(73) Assignee: COMPAIR DRUCKLUFTTECHNIK—ZWEIGNIEDERLASSUNG DER Gardner Denver Deutschland GMBH, Simmern (DE)

( * ) Notice: Subject to any disclaimer, the term of this patent is extended or adjusted under 35 U.S.C. 154(b) by 0 days.

(21) Appl. No.: 18/552,590

(22) PCT Filed: Apr. 26, 2022

(86) PCT No.: PCT/EP2022/060967

§ 371 (c)(1),
(2) Date: Apr. 12, 2024

(87) PCT Pub. No.: WO2022/229133

PCT Pub. Date: Nov. 3, 2022

(65) Prior Publication Data

US 2024/0280105 A1 Aug. 22, 2024

(30) Foreign Application Priority Data

Apr. 30, 2021 (DE) ..... 102021111297.4

(51) Int. Cl.
*F04C 29/00* (2006.01)
*F04C 18/16* (2006.01)

(52) U.S. Cl.
CPC ..... *F04C 29/005* (2013.01); *F04C 18/16* (2013.01); *F04C 2240/60* (2013.01)

(58) Field of Classification Search
CPC ..... F04C 18/16; F04C 23/001; F04C 23/02; F04C 28/02; F04C 28/08; F04C 29/005; F04C 2240/60; F04C 2240/70
See application file for complete search history.

(56) References Cited

U.S. PATENT DOCUMENTS 3,910,731 A 10/1975 Persson et al.
4,068,984 A * 1/1978 Spindler ..... F04C 18/16 418/199

(Continued)

FOREIGN PATENT DOCUMENTS

CN 109209875 B 5/2020
DE 10047940 A1 12/2001

(Continued)

OTHER PUBLICATIONS

International Preliminary Report on Patentability for PCT/EP2022/060967, dated Oct. 24, 2023.

(Continued)

*Primary Examiner* — Dapinder Singh
(74) *Attorney, Agent, or Firm* — Kevin E. West; Advent, LLP

(57) ABSTRACT

A drive system for a multistage screw compressor with a first compressor stage with a first main rotor mounted on a first shaft in a torque-proof manner and a second compressor stage with a second main rotor mounted on a second shaft in a torque-proof manner. The drive system has a drive shaft for driving the shafts of both main rotors of the first and second compressor stages, wherein the driving of the shaft of the first main rotor takes place independently of the driving of the shaft of the second main rotor, so that the rotational speeds of the two main rotors can preferably be adapted independently of one another.

20 Claims, 6 Drawing Sheets

(56) References Cited

U.S. PATENT DOCUMENTS

| | | | | |
|---|---|---|---|---|
| 4,524,638 | A | 6/1985 | Van Hee | |
| 5,378,128 | A | 1/1995 | Yanagisawa | |
| 5,680,793 | A * | 10/1997 | Flamang | F16H 57/033 74/325 |
| 6,634,853 | B1 | 10/2003 | Anderson | |
| 6,991,440 | B2 | 1/2006 | Achtelik et al. | |
| 7,140,846 | B2 * | 11/2006 | Yamamoto | F04C 23/001 417/423.1 |
| 7,559,752 | B2 * | 7/2009 | Bahnen | F04C 23/02 417/410.4 |
| 9,074,524 | B2 * | 7/2015 | Eybergen | F04C 18/126 |
| 10,947,976 | B2 * | 3/2021 | Yano | F04C 18/16 |
| 2017/0292525 | A1 | 10/2017 | Andrews et al. | |
| 2018/0119601 | A1 | 5/2018 | Lin et al. | |

FOREIGN PATENT DOCUMENTS

| | | | |
|---|---|---|---|
| DE | 10115648 | A1 | 5/2002 |
| DE | 102017206240 | B3 | 8/2018 |
| EP | 3315779 | A1 | 5/2018 |
| JP | 2020037922 | A | 3/2020 |

OTHER PUBLICATIONS

Office Action for German Application No. 10 2021 111 297.4, dated Jan. 12, 2022.

PCT Search Report and written opinion for PCT/EP2022/060967, dated Sep. 6, 2022.

* cited by examiner

DRIVE SYSTEM FOR A MULTI-STAGE SCREW COMPRESSOR

BACKGROUND

Multistage screw compressors conventionally use a 3-wheel gearing mechanism in which a drive wheel arranged on the drive shaft is engaged with the two drive pinions arranged on the respective propeller shafts of the first and second compressor stages, in order to drive the two compressor stages.

DRAWINGS

The present system is explained in greater detail hereafter using various exemplary embodiments and with reference to the drawings. In the figures.

Figure 6B:
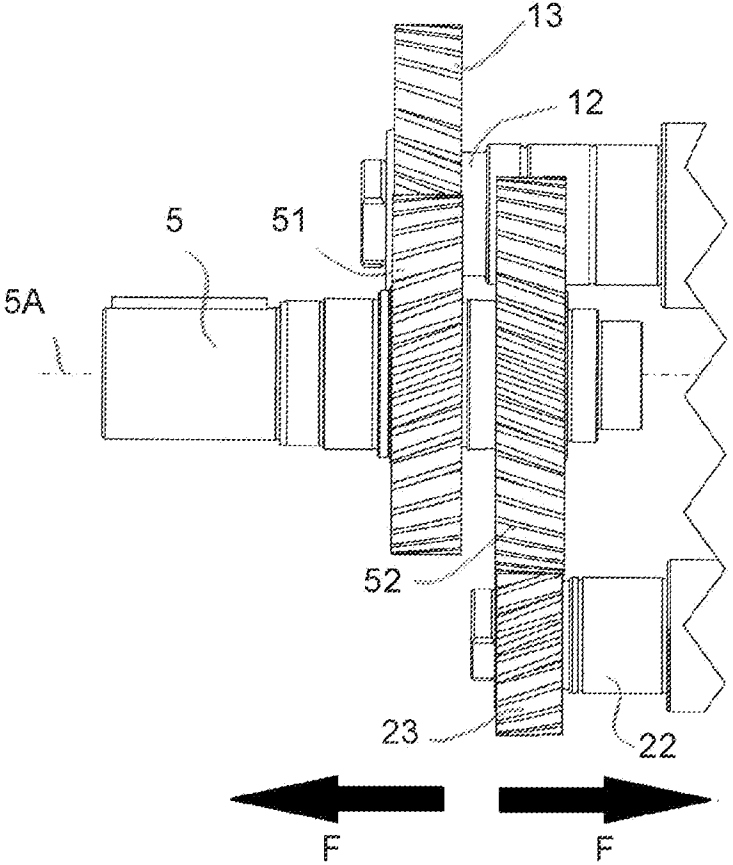
Figure 6A:
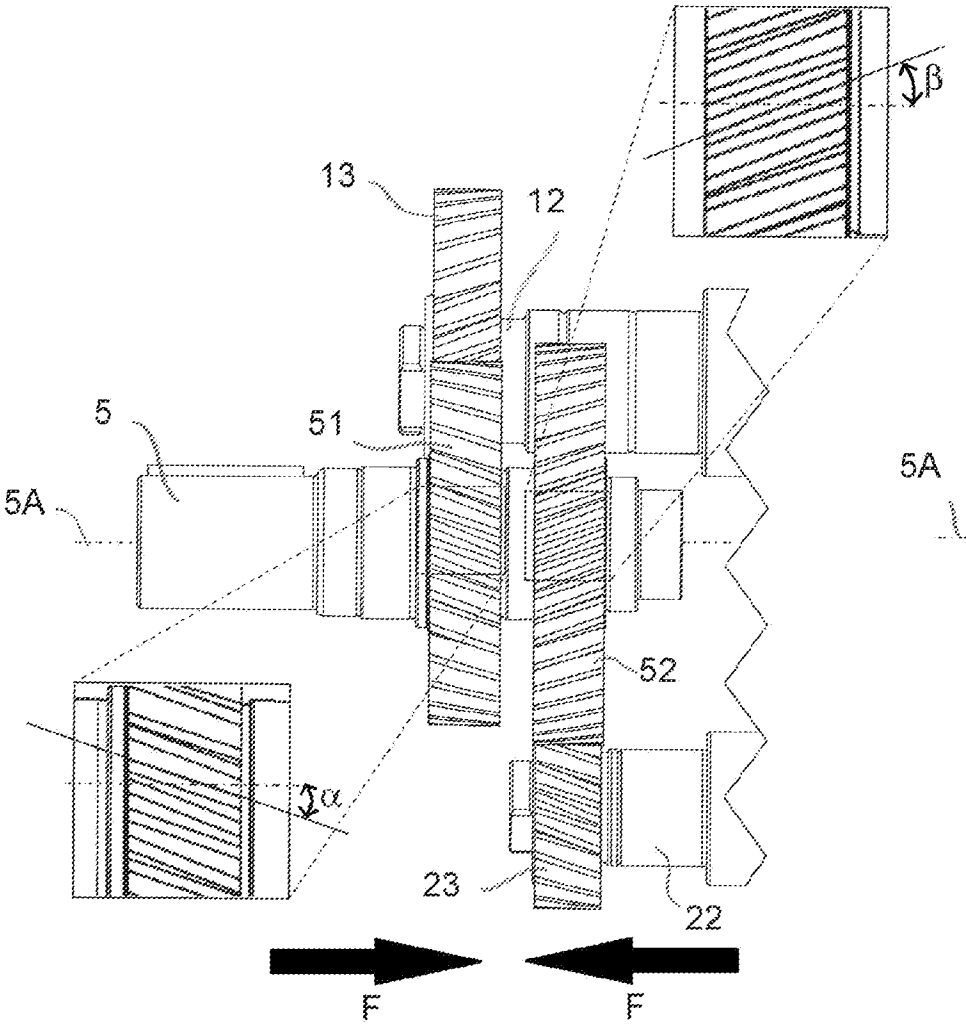

FIG. 6*a-b* shows a side view of the gearing mechanism of the compressor shown in the previous figures.

FIG. 7*a-f* shows schematic front views of various drive systems according to an example embodiment of the present disclosure.

DETAILED DESCRIPTION

Overview

In a two-stage screw compressor, there arises between the first and second stages an intermediate pressure which depends on the end pressure and which, in principle, corresponds to the end pressure of the first stage. This intermediate pressure arises in that the first stage conveys a greater volume flow than the second stage is able to transport away. This has the consequence that the rotational speed of the second stage may be set in a defined ratio to the rotational speed of the first stage, in order for an optimal intermediate pressure to arise. The respective pressure ratios of the individual compressor stages in turn determine the distribution of the total power within the two-stage compressor.

The intermediate pressure has significant effects on the overall efficiency of the compressor. In principle, a compressor generates pressure by enclosing a certain quantity of air and continuously decreases the volume of the enclosed quantity of air until a defined pressure is produced. The volume ratio, i.e. the initial volume of the enclosed gas (when the pressure chamber of the compressor is just closing) to the end volume at the time of the defined pressure (when the pressure chamber opens again) is determined during the construction of the compressor and is constant. The greatest efficiency is achieved when the pressure chamber of the compressor opens and here the same pressure prevails in the adjoining pressure vessel.

In a two-stage compressor, this pressure vessel in the first stage is the intermediate chamber between the two compressor stages with the intermediate pressure described above. In the second stage of the compressor, this pressure vessel is the pressure chamber which is connected to the compressor, or the consumer network which has the constant end pressure.

If a higher pressure prevails in the respective pressure vessel than in the pressure chamber at the time of opening, we speak of under-compression. In the opposite case, i.e. if a lower pressure prevails in the respective pressure vessel than in the pressure chamber at the time of opening, we speak of over-compression. In both cases, i.e. both in the case of over-compression, and in the case of an under-compression, significant losses in efficiency are caused.

In a two-stage compressor, the intermediate pressure corresponds to the suction pressure of the second compressor stage, wherein the suction pressure is the pressure which prevails upon closing of the pressure vessel of the respective compressor stage. Consequently, if the intermediate pressure deviates from the optimal setting, the optimal suction pressure is not generated, during the compression process, in the second stage and there is over-compression or under-compression with regard to the end pressure, and thus there is a significant loss in efficiency of the two-stage compressor.

Consequently, if a two-stage compressor is operated with a volume ratio stipulated by the construction, at different end pressures, the intermediate pressure may be set by adapting the rotational speed of the two compressor stages to the respective end pressure, in order to achieve maximum efficiency.

In contrast, if a two-stage screw compressor is operated at different powers, the rotational speed of the first stage is altered in order to influence the power of the screw compressor, and the rotational speed of the second stage may be adapted to it in order to obtain the optimal intermediate pressure which generates the greatest efficiency.

However, the rotors of the two stages of the compressor are normally installed in a common rotor housing, so that the position of the driven main rotors is fixed and the gearing mechanism consequently has an unchanging axial spacing. However, in the case of the conventional 3-wheel driving via a common drive wheel, the transmission ratio between the first stage and the second stage can be altered only to a small degree by modifying the tooth geometry, for example by displacing the profile of the sprockets which engage one another.

In other words, in the case of the conventional 3-wheel gearing mechanisms, in the case of alteration of the overall power of the two-stage compressor through a change in the transmission between the driving mechanism and the first compressor stage, the transmission ratio to the second compressor stage is no longer defined, but rather necessarily arises through the axial spacing between the drive shaft and the second compressor stage. As a result, the second compressor stage can no longer transport the envisaged quantity of volume flow away from the intermediate chamber, which means that this power change gives rise to an unfavorable intermediate pressure which in turn results in a significant loss of efficiency.

In summary, a significant and undesirable loss of efficiency arises in the event of a change in the overall power, in the end pressure or in the volume flow of a two-stage compressor in the event of the use of the conventional 3-wheel gearing mechanism, in particular in the case of a structurally fixed and unchangeable spacing of the axes of the main rotors to the drive shaft.

The present system has the objective of avoiding the aforementioned problem and of making it possible, in the event of a multistage, in particular two-stage, compressor, to change the overall power, the end pressure or the volume flow, in particular in the case of a structurally fixed and unchangeable spacing of the axes of the main rotors to the drive shaft without significant losses in efficiency.

A drive system according to the disclosure for a multi-stage screw compressor comprises a first compressor stage with a first main rotor mounted on a first shaft in a torque-proof manner and a second compressor stage with a second main rotor mounted on a second shaft in a torque-proof manner. In this case, the drive system has a drive shaft for driving the shafts of both main rotors of the first and second compressor stages. According to embodiments, the driving of the shaft of the first main rotor takes place independently of the driving of the shaft of the second main rotor.

Advantageously, in an embodiment, due to the driving of the shaft of the first main rotor independently of the driving of the shaft of the second main rotor, the rotational speeds of the main rotors can be adapted independently of one another.

In particular, the ratio of the rotational speeds relative to one another is preferably freely selectable here, while the rotational speed ratio of the two rotors in a usual 3-wheel gearing mechanism is stipulated by the construction.

In the term of the present disclosure, an independent driving of the two shafts of the main rotors should be understood such that the two shafts are driven by a common drive shaft but, in contrast to the 3-wheel gearing mechanism, are not driven via the same drive wheel on the drive shaft.

In an embodiment, the drive shaft can, in this sense, have two drive wheels arranged on the drive shaft in a torque-proof manner. The first drive wheel of these two drive wheels is in engagement with a first output pinion which is arranged on the shaft of the first main rotor in a torque-proof manner, while the second drive wheel of the two drive wheels is in engagement with a second output pinion which is arranged on the shaft of the second main rotor in a torque-proof manner.

Through the 4-wheel gearing mechanism according to embodiments, the adaptation of the intermediate pressure by freely selecting the transmission ratios between the two compressor stages can be implemented very simply and it is also possible to cover ranges which cannot be accomplished by merely changing the tooth geometry in a 3-wheel gearing mechanism. This leads to significant advantages in operating the compressor in the case of changes in the overall power, different end pressures and altered volume flows, since it is possible to avoid power losses through over-compression and under-compression which are caused by thermodynamics.

Furthermore, since, in the event of using the 4-wheel gearing mechanism, the intermediate pressure is no longer substantially stipulated by the given axial spacing as depicted above for the 3-wheel gearing mechanism, the arrangement of the individual compressor stages can be freely selected. The resulting compact and weight-saving construction, and the possibility of a greater integration of functions into the compressor housing give rise to significant cost benefits.

Since, with the 4-wheel gearing mechanism, it is possible to freely arrange all compressor stages, it is, in contrast to the 3-wheel gearing mechanisms, also possible to freely form the inlets and outlets and the intermediate spaces inside the compressor housing. As a result, it is possible to implement an arrangement which is favorable in terms of flow mechanics through reduction of diversions and adapted arrangement of the inner flow channels and the inlets and outlets. In addition to the compactness, this results in a further, not inconsiderable gain in efficiency.

Furthermore, the setting of the best-possible intermediate pressure, accomplished by freely selecting the transmission ratios between the two compressor stages also enables an optimization of an oil-flooded compressor operated at constant rotational speed, because in this case the injection temperature of the oil, which also has a strong influence on the intermediate pressure and the efficiency, can be selected in a thermodynamically favorable manner just over the outage point of condensed water.

In this sense, an embodiment relates to an oil-injected compress form and lifespan of the bearings used in the system for the rotor shafts, as will be depicted below.

A screw compressor usually comprises one or more pairs of screws from the main rotor and subsidiary rotor, which engage one another in a helical shape. The screws of the two rotors each possess different pitches and numbers of teeth, such that in the event of rotational movement a chamber is formed between each tooth intermediate space of the rotors, this chamber decreasing in size steadily and thus generating the desired pressure. For this reason, different pressures arise at different axial locations of the screw pair. Through this drop in pressure, there arise axial and radial forces on the rotors, which are absorbed by the bearing of the two rotors. The forces caused and generated by the rotor geometry are independent of intermediate and end pressure, but not of the power of the compressor. The resulting radial force is absorbed by the radial bearings and the axial force is absorbed by the axial bearings. Through the different geometry of the main and subsidiary rotors, the proportions of the resulting forces exert an effect differently in the radial and axial directions. In the case of the main rotor, there usually arises the largest axial force.

Since, as described above, the forces acting on the rotor bearings are produced by the pressure drop which arises in the rotor helix and since this pressure drop depends on the respective suction or end pressure of the individual stages, the intermediate pressure, which of course represents the end pressure of the first stage and the suction pressure of the second stage, also has an influence on the bearing forces of the individual compressor stages. If the intermediate pressure is too high, the bearings of the first stage are stressed to a greater degree, and if it is too low, the bearings of the second stage are stressed to a greater degree. As described above, the intermediate pressure in the normal 3-wheel drives cannot be kept constant in the event of changes in the overall power, different end pressures, altered volume flows and also in the event of different injection temperature in the case of an oil-flooded compressor. All of these cases may be taken into account in the bearing design, which inevitably leads to a higher degree of bearing stress and to more expensive bearings or a reduced bearing lifespan.

Since it is possible to keep the intermediate pressure constant using the 4-wheel gearing mechanism according to an embodiment, an exact, inexpensive bearing with a long lifespan can be employed.

Advantageously, in a preferred embodiment of the drive system according to embodiment, the two drive wheels on the drive shaft can be fitted against one another, which can lead to increased stability of the drive wheels against forces which act axially.

Furthermore, in a preferred embodiment, the gearing mechanism can have, between the second drive wheel and the second output pinion, a different or identical transmission than the gearing mechanism between the first drive wheel and the first output pinion in order to guarantee the higher speed of the second compression stage which is usually required during operation.

Advantageously, the toothing between at least one of the drive wheels and the corresponding output pinion, can be formed to be inclined relative to the axial extent of the drive shaft. In this case, the toothing between both drive wheels and the respective output pinions can be formed to be inclined relative to the axial extent of the drive shaft, wherein the angles formed by the toothing of the respective drive wheel with the output pinion relative to the axial extent of the drive shaft can be different. In particular, in this case the angles formed by the toothing of the respective drive wheel with the output pinion relative to the axial extent of the drive shaft can have different signs.

Inclined toothing of the drive wheels and the respective output pinions can advantageously be employed to control axial forces which act on the rotors and their shafts during operation, as will be described in detail below.

As depicted above, the pressure drop in the pairs of screws of the individual compressor stages leads to radially-acting and axial-acting forces on the rotors and their shafts.

Through the use of inclined toothing of the drive wheel and of the output pinion, additional forces are produced in the system. In particular, by means of the inclined toothing, there arise axial forces which depend on the angle of incline and which act on the drive shaft and the driven rotor. In contrast to the forces produced by the gas forces, the forces generated by the gearing mechanism wheels depend on the power of the compressor and the selected transmission. The axial forces generated by the inclined toothing can exert stress onto, or take stress off of, the axial rotor bearing of the driven main rotor depending on the orientation of the angle of incline of the of the gearing mechanism. As a result, as the case may be, any smaller axial bearings can be used at the rotors, or in the opposing case a defined force can be applied onto the axial rotor bearing.

In the case, according to an embodiment, of a 4-wheel gearing mechanism with the arrangement of two drive wheels, the possibility arises of controlling the axial force in a targeted manner by altering the angle of incline of the teeth of the gearing mechanism on each of the two drive wheels. If angles of incline are used here which have different signs viewed relative to the axial extent of the drive shaft, then the forces produced by the inclined toothing can at least partly cancel one another out, meaning that smaller bearings can be used at the drive shaft. Furthermore, using different angles of incline makes it possible to match the direction of force and the amount of force to the existing bearing in all power ranges and transmission ratios. This matching of the bearing forces has the advantage that smaller bearings can be employed, which has a cost benefit, and a longer bearing lifespan can be achieved.

Alongside control of the axial forces acting on the drive shaft, it is also possible control or reduce the gearing mechanism forces acting on the rotor bearing by appropriately selecting and adapting the inclined toothing of the individual drive wheels to one another. If, in the case of a screw compressor, the geometry of the rotors and the arising pressure drop produce a high axial force at the the driven rotor, then, using the 4-wheel gearing mechanism according to an embodiment and corresponding inclined toothing between the respective drive wheel and the associated output pinion, it is possible to counteract, in a targeted manner, the axial force generated by the pressure drop individually at each compressor stage, or to strengthen it.

Of course, this is the case with more than the described two-stage compressors (e.g. three-stage and multistage compressors) and can be matched to all power ranges and transmission ratios. This matching of the bearing forces has the advantage that smaller bearings can be employed, which has a cost benefit, and a longer bearing lifespan can be achieved.

According to a further aspect of an embodiment, the drive system described in detail above is used in a two-stage compressor, this being, in an embodiment, an oil-injected compressor in which the advantages of the embodiment which are described above can be employed in a particularly beneficial manner.

Example Embodiments

Figure 1:
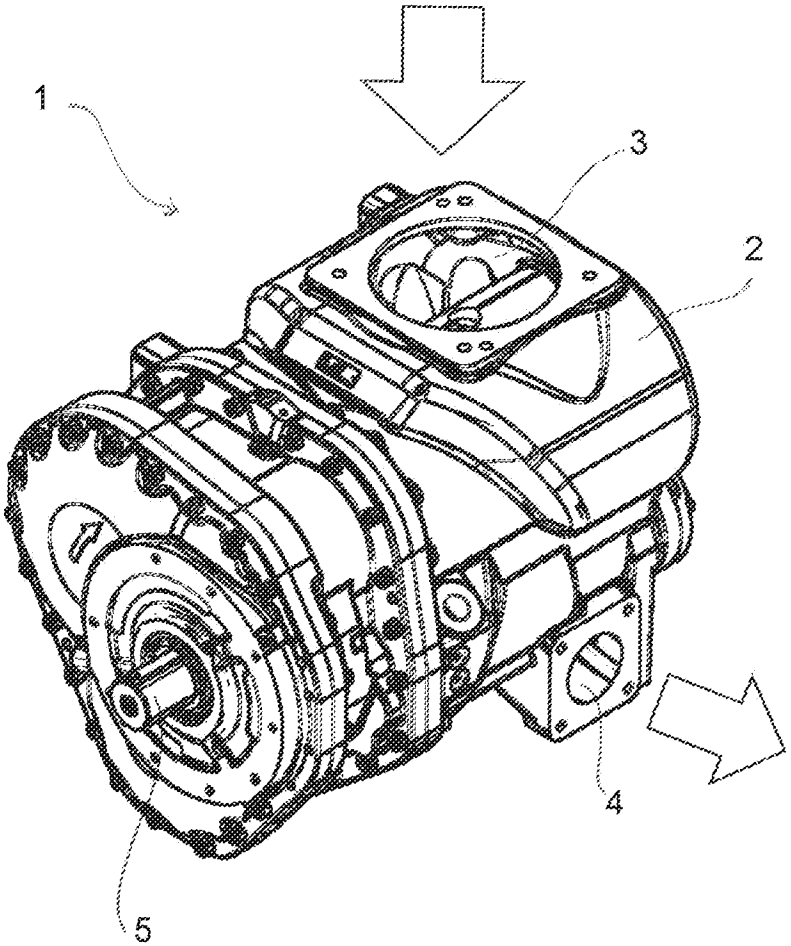
FIG. 1 shows a compressor with a drive system according to an example embodiment of the present disclosure, in a perspective view.

FIG. 1 shows a perspective view of a compressor 1 with a compressor housing 2 which accommodates an embodiment of the drive system according to the invention. The compressor depicted in the figures is an oil-injected compressor, with the drive system according to the invention, as described above, also being able to be used in compressors which have no oil injection.

The compressor has an inlet 3 and an outlet 4, through which the medium to be compressed is supplied or discharged respectively, as can be seen from the arrows. The drive shaft 5 which protrudes from the housing 2 is rotatively driven in the direction characterized by the arrow R by means of a motor which is not shown.

Figure 2:
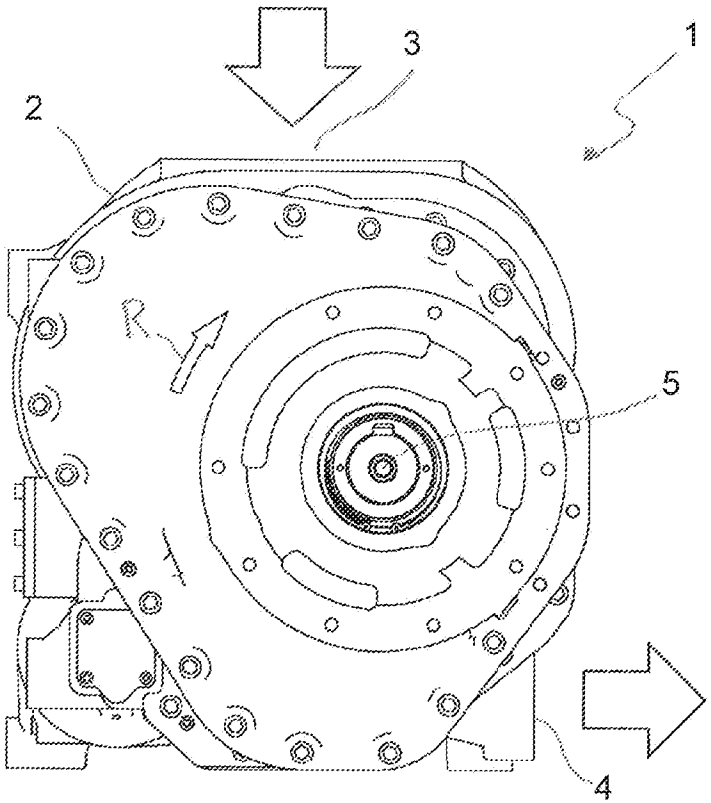
FIG. 2 shows a view of the compressor from FIG. 1, in front view.

The compressor 1 depicted in FIG. 1 is depicted once again in FIG. 2, in a front view.

Figure 3:
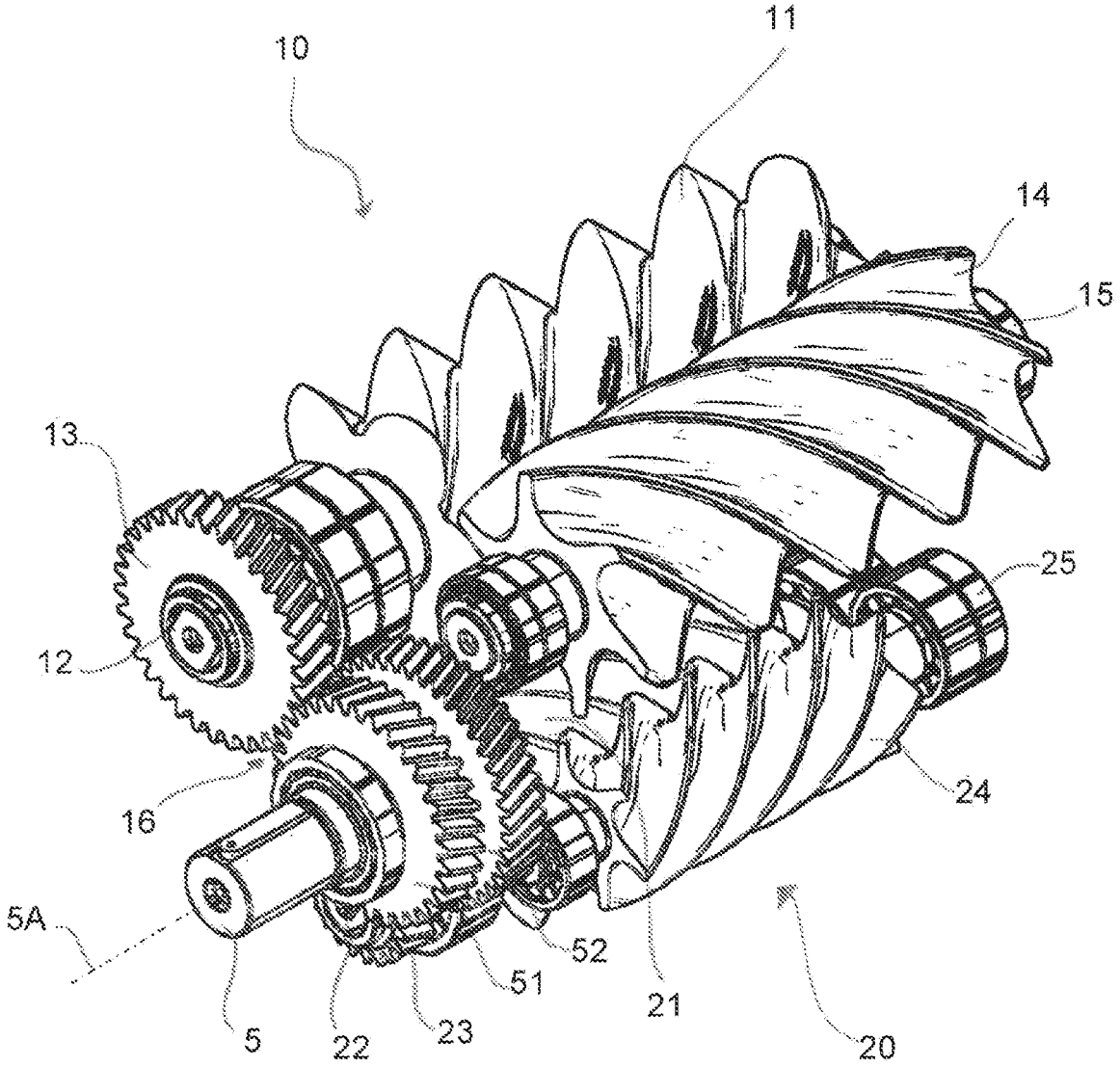
FIG. 3 shows a perspective view of the two compressor stages of the compressor from FIG. 1.
Figure 4:
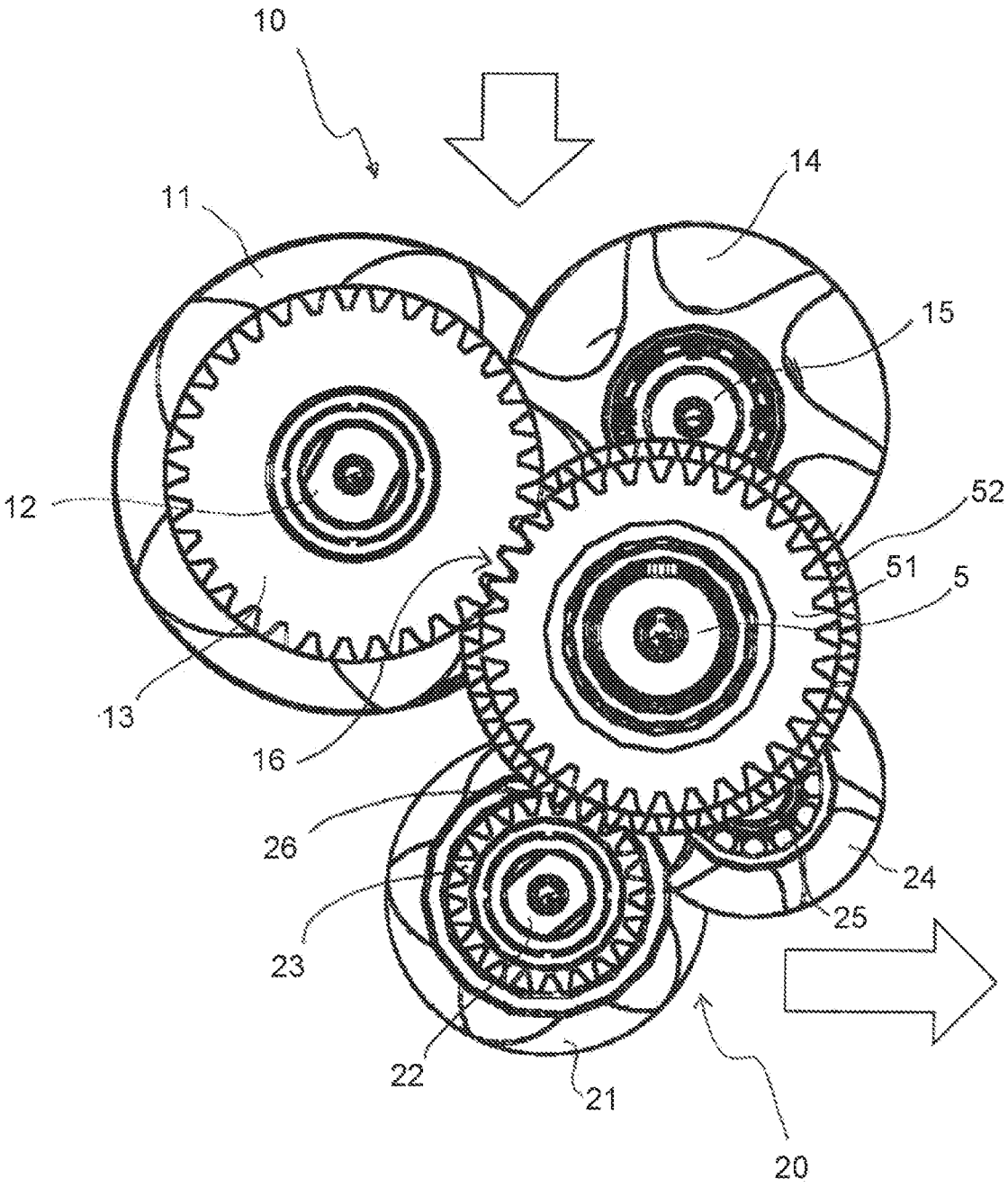
FIG. 4 shows a front view of the compressor stages shown in FIG. 3.
Figure 5:
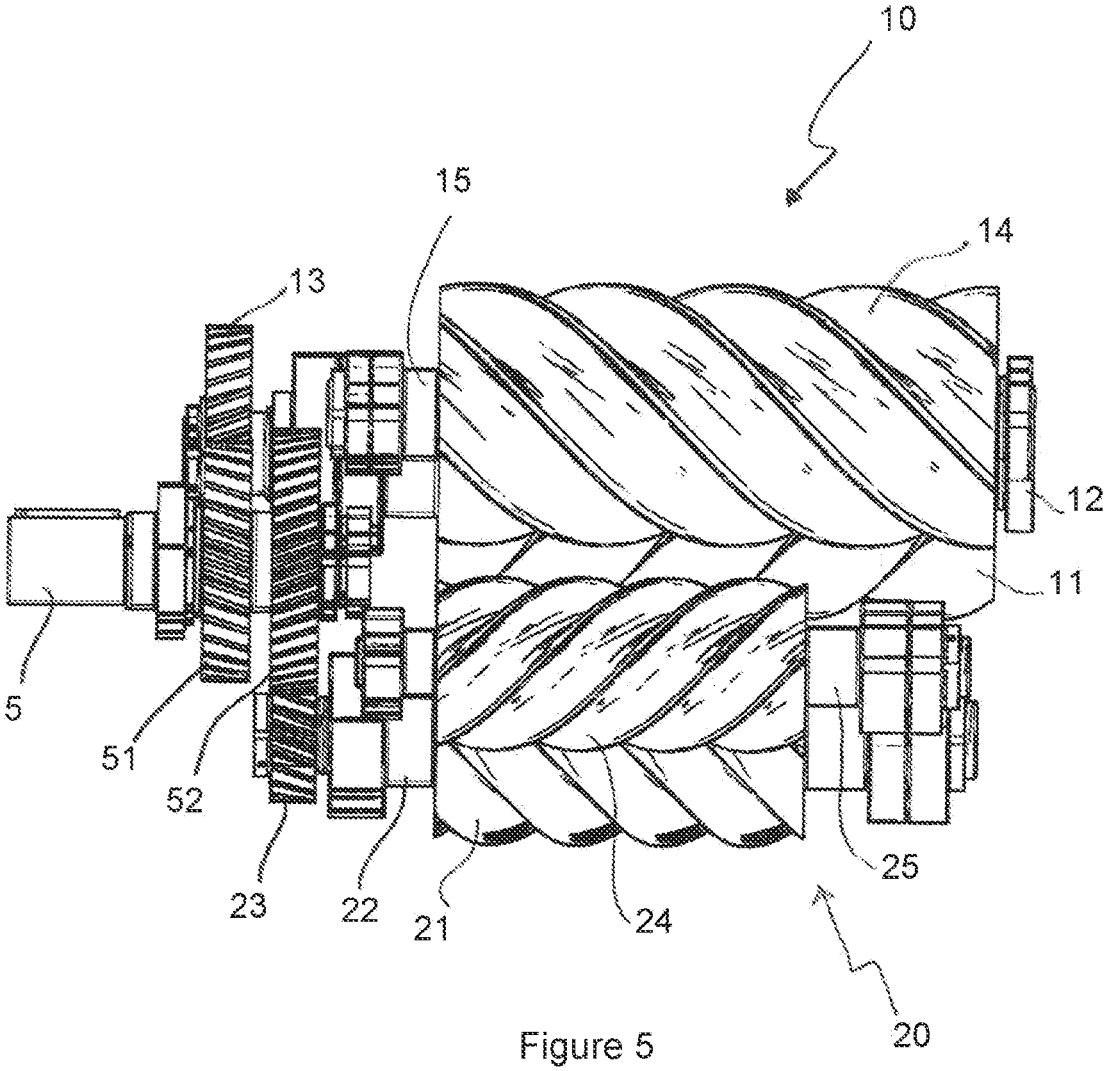
FIG. 5 shows a side view of the compressor stages shown in FIG. 3.

The compressor 1 depicted in FIG. 1 and FIG. 2 is a two-stage compressor and the two compressor stages 10 and 20 are depicted in FIGS. 3-5.

Here, the first compressor stages 10 comprises a main rotor 11 and a subsidiary rotor 14 which engage one another in a rotating manner to compress the medium fed into the housing 2 via the inlet 3. Here, the two rotors 11 and 14 are mounted on their respective shafts 12 and 15 in a torque-proof manner.

Here, the second compressor stage 20 also comprises a main rotor 21 and a subsidiary rotor 24, which engage one another to further compress the medium delivered from the first compressor stage 10. The two rotors 21 and 24 of the second compressor stage are mounted on their respective shafts 22 and 25 in a torque-proof manner.

All shafts are mounted in a conventional manner inside the housing, with the details of the mounting not being depicted for the sake of clarity.

For the purpose of independently driving the two compressor stages 10, 20, the drive shaft 5 has a first drive wheel 51 and a second drive wheel 52 which are each mounted on the drive shaft 5 in a torque-proof manner.

The first drive wheel 51 has, on its peripheral surface, a toothing which engages a corresponding toothing of a first output pinion 13, which is mounted in a torque-proof manner on the shaft 12 of the first main rotor 11, so that a rotation of the drive shaft 5 and of the first drive wheel 51 leads to a corresponding rotation of the shaft 12 of the first main rotor 11. In the case of the oil-injected compressor depicted in the figures, the first subsidiary rotor 14 is driven by the first main rotor 11 via the helical toothing with a transmission ratio which emerges from the respective numbers of teeth of the two rotors. The rotational speed of the first main rotor 11 is determined by the transmission between the first drive wheel 51 and the first output pinion 13.

In the case of a non-oil-injected compressor, the first main rotor and the first subsidiary rotor can also be rotatively connected to one another via an additional gearing mechanism, such that the two rotors, when in operation, rotate synchronously, engaging one another.

In the depicted embodiment, the toothing 16 between the first drive wheel 51 and the first output pinion 13 are designed to be inclined relative to the axis 5A of the shaft 5, as will still be described in detail later in conjunction with FIGS. 6*a* and 6*b*.

The second drive wheel 52 also has, on its peripheral surface, a toothing which, however, engages a corresponding toothing of a second output pinion 23, which is mounted in a torque-proof manner on the shaft 22 of the second main rotor 21, so that a rotation of the drive shaft 5 and of the second drive wheel 52 leads to a corresponding rotation of the shaft 22 of the first main rotor 21. Here too, the second subsidiary rotor 24 is driven by the second main rotor 21 via the helical toothing with a transmission ratio which emerges from the respective numbers of teeth of the two rotors. The rotational speed of the second main rotor 21 is determined by the transmission between the second drive wheel 52 and the second output pinion 23 and can be adapted independently of the rotational speed of the first main rotor 11 by appropriately adapting the radial size of the two elements.

Here too, it is again true that in in the case of a non-oil-injected compressor, the second main rotor and the second subsidiary rotor can be rotatively connected to one another via an additional gearing mechanism, such that the two rotors, when in operation, rotate synchronously, engaging one another.

In the depicted embodiment, the toothing 26 between the second drive wheel 52 and the second output pinion 23 are designed to be inclined relative to the axis 5A of the shaft 5, as will still be described in detail later in conjunction with FIGS. 6*a* and 6*b*.

The gearing mechanism of the embodiment, depicted in the preceding figures, of the drive system is depicted in a side view in FIGS. 6*a* and 6*b*.

As already mentioned, in the depicted embodiment, the teeth which are arranged on the peripheral sides of the drive wheels 51 and 52 and of the output pinions 13 and 23 and which are engaged are arranged inclined relative to the axis 5A of the drive shaft.

Here, the teeth arranged on the first drive wheel 51 form an angle α to the axis 5A, while the teeth arranged on the second drive wheel 52 form an angle β to the axis 5A, as is depicted schematically in FIG. 6*a*.

Due to this inclined toothing 16, 26, when the drive shaft 5 rotates in the direction of rotation R, there arise axial forces F which act on the drive shaft 5 and which are depicted in FIGS. 6*a* and 6*b*.

By appropriately selecting the angles α and β and the transmission ratios between the drive wheels 51, 52 and the associated output pinions 13, 23, it is possible to control the axial forces on the drive shaft 5 caused by the rotation.

In the exemplary embodiment depicted in FIGS. 6*a* and 6*b*, the angles α and β relative to the axis 5A of the drive shaft have different signs, such that the forces resulting in each case are opposed to one another.

However, it would also be conceivable for the angles α and β relative to the axis 5A to have the same sign, such that the axial forces on the drive shaft 5 which result in each case are directed in the same direction.

FIGS. 7*a*-7*e* depict examples of different arrangements of two compressor stages which have a drive system. The free selection, schematically indicated by corresponding arrows in the figures, of the axial spacings of the drive shaft 5 to the shaft 12 of the first main rotor 11 and to the shaft 22 of the second main rotor 21 through the use, in accordance with an embodiment, of a second drive wheel 52, gives rise to great flexibility as to how the two compressor stages are arranged relative to one another in the housing.

Figure 7A:
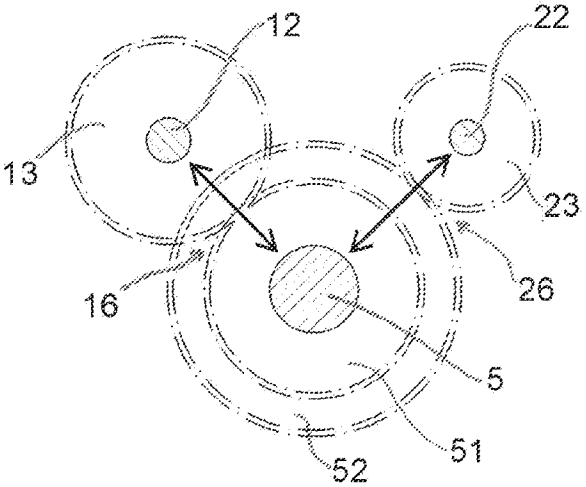
Figure 7B:
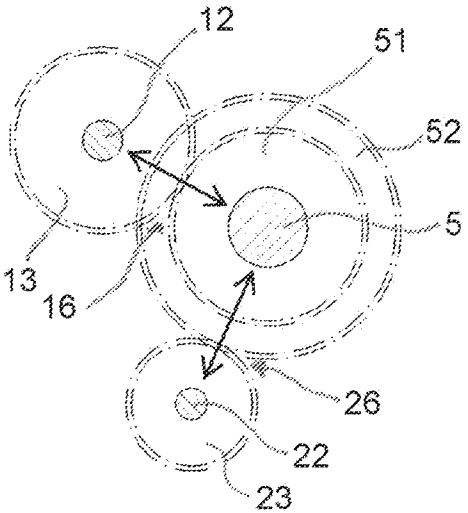
Figure 7C:
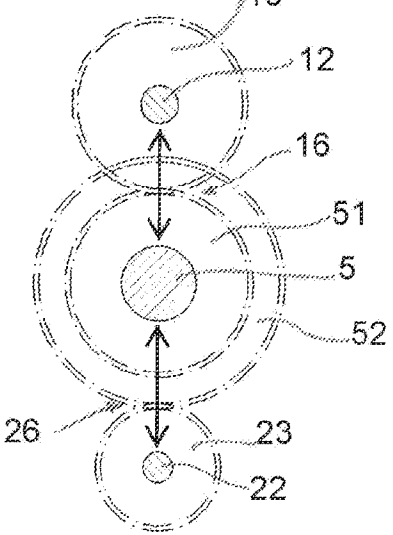
Figure 7D:
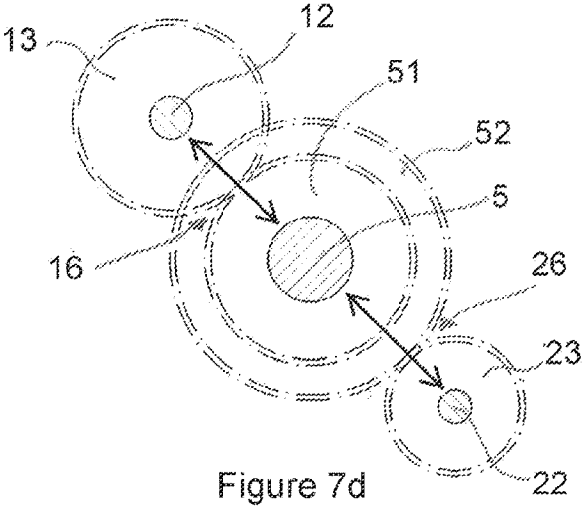
Figure 7E:
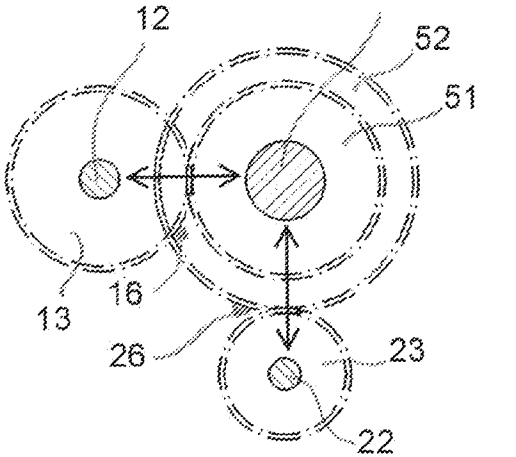
Figure 7F:
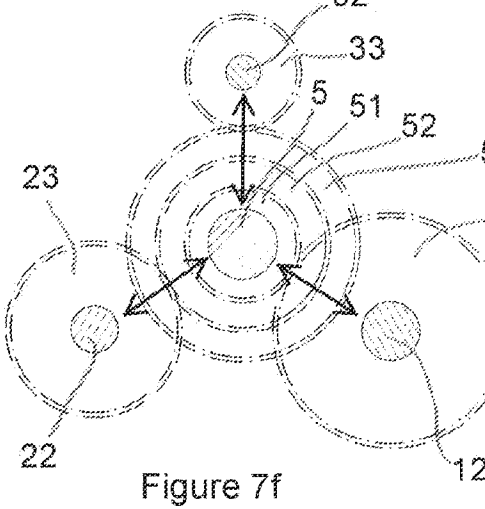

FIG. 7*f* shows an example of a three-stage compressor which uses a drive system according to an embodiment in which a third drive wheel 53 is additionally mounted on the drive shaft 5 in a torque-proof manner and engages in a third output pinion 33 which is mounted on the shaft 32 of a main rotor of the third compressor stage in a torque-proof manner, in order to accomplish a driving of a third compressor stage which is caused via the common drive shaft 5 but which is independent from the driving of the first two compressor stages.

LIST OF REFERENCE NUMBERS

1 Compressor
2 Compressor housing
3 Inlet
4 Outlet
5 Drive shaft
5A Axial axis of the drive shaft
51 First drive wheel
52 Second drive wheel
53 Third drive wheel
10 First compressor stage
11 First main rotor
12 Shaft of the first main rotor
13 First output pinion
14 First subsidiary rotor
15 Shaft of the first subsidiary rotor
16 Toothing between the first drive wheel and the first output pinion
α a Angle between the first toothing and the axis of the drive shaft
20 Second compressor stage
21 Second main rotor
22 Shaft of the second main rotor
23 Second output pinion
24 Second subsidiary rotor
25 Shaft of the second subsidiary rotor
26 Toothing between the second drive wheel and the second output pinion
β Angle between the second toothing and the axis of the drive shaft
32 Shaft of a third main rotor
33 Third output pinion
F Effective direction of axial forces
R Direction of rotation of the drive shaft

The invention claimed is:

1. A drive system for a multistage screw compressor comprising:

a housing including a housing cavity, a fluid inlet and a fluid outlet;

a first compressor stage including a first main rotor mounted on a first shaft in a torque-proof manner, the first shaft defining a first shaft axis;

a second compressor stage including a second main rotor mounted on a second shaft in a torque-proof manner, the second shaft defining a second shaft axis parallel to the first shaft axis and;

a drive shaft configured to respectively drive the first shaft of the first main rotor and the second shaft of the second main rotor of the first and second compressor stages, wherein the housing houses the first compressor stage, the second compressor stage and the drive shaft within the housing cavity, and where the drive shaft is configured to drive the first shaft of the first main rotor independently from the second shaft of the second main rotor.

2. The drive system according to claim 1, wherein respective rotational speeds of the first main rotor and the second main rotor are configured to be adapted independently of one another.

3. The drive system according to claim 2, wherein the ratio of the respective rotational speeds of the first main rotor and the second main rotor relative to one another can be freely selected.

4. The drive system according to claim 1, wherein the drive shaft has a first drive wheel and a second drive wheel arranged on the drive shaft in a torque-proof manner, the first drive wheel engaging with a first output pinion, the first output pinion arranged on the first shaft in a torque-proof manner, and the second drive engaging with a second output pinion the second output pinion arranged on the second shaft in a torque-proof manner.

5. The drive system according to claim 4, further comprising a gearing mechanism having a different transmission between the second drive wheel and the second output pinion to the gearing mechanism between the first drive wheel and the first output pinion.

6. The drive system according to claim 4, further comprising a gearing mechanism having a shared transmission between the second drive wheel and the second output pinion as the gearing mechanism between the first drive wheel and the first output pinion.

7. The drive system according to claim 4, wherein toothing between at least one of the first drive wheel or the second drive wheel and the corresponding first output pinion or second output pinion-is formed at an incline to the axial extent of the drive shaft.

8. The drive system according to claim 7, wherein the toothing between the first drive wheel and the second drive wheel and the respective first output pinion and second output pinion is formed at an incline to the axial extent of the drive shaft and wherein angles $\alpha$ and $\beta$ formed by the toothing of the respective drive wheel with the output pinion to the axial extent of the drive shaft are different.

9. The drive system according to claim 8, wherein the angles $\alpha$ and $\beta$ formed by the toothing of the respective first drive wheel and second drive wheel with the first output pinion and second output pinion to the axial extent of the drive shaft have different signs.

10. A screw compressor comprising:

a housing including a housing cavity, a fluid inlet, and a fluid outlet;

a first compressor stage with a including a first main rotor mounted on a first shaft in a torque-proof manner, the first shaft defining a first shaft axis;

a second compressor stage including a second main rotor mounted on a second shaft in a torque-proof manner, the second shaft defining a second shaft axis parallel to the first shaft axis and;

a drive system for driving the screw compressor, the drive system including:

a drive shaft configured to respectively drive the first shaft of the first main rotor and the second shaft of the second main rotor of the first and second compressor stages, wherein the housing houses the first compressor stage, the second compressor stage, and the drive system within the housing cavity, and where the drive shaft is configured to drive the first shaft of the first main rotor independently from the second shaft of the second main rotor.

11. The screw compressor according to claim 10, wherein the screw compressor is an oil-injected compressor.

12. The screw compressor according to claim 10, wherein respective rotational speeds of the first main rotor and the second main rotor are configured to be adapted independently of one another.

13. The screw compressor according to claim 12, wherein the ratio of the two respective rotational speeds of the first main rotor and the second main rotor relative to one another can be freely selected.

14. The screw compressor according to claim 10, wherein the drive shaft has a first drive wheel and a second drive wheel arranged on the drive shaft in a torque-proof manner, the first drive wheel engaging with a first output pinion, the first output pinion arranged on the first shaft in a torque-proof manner, and the second drive wheel engaging with a second output pinion the second output pinion arranged on the second shaft in a torque-proof manner, where the first drive wheel is adjacent to the second drive wheel.

15. The screw compressor according to claim 14, further comprising a gearing mechanism having a different transmission between the second drive wheel and the second output pinion to the gearing mechanism between the first drive wheel and the first output pinion.

16. The screw compressor according to claim 14, further comprising a gearing mechanism having a shared transmission between the second drive wheel and the second output pinion as the gearing mechanism between the first drive wheel and the first output pinion.

17. The screw compressor according to claim 14, wherein toothing between at least one of the first drive wheel or the second drive wheel and the corresponding first output pinion or second output pinion is formed at an incline to the axial extent of the drive shaft.

18. The screw compressor according to claim 17, wherein the toothing between the first drive wheel and the second drive wheel and the respective first output pinion and second output pinion is formed at an incline to the axial extent of the drive shaft and wherein angles $\alpha$ and $\beta$ formed by the toothing of the respective drive wheel with the output pinion to the axial extent of the drive shaft are different.

19. The screw compressor according to claim 18, wherein the angles $\alpha$ and $\beta$ formed by the toothing of the respective first drive wheel and second drive wheel with the first output pinion and second output pinion to the axial extent of the drive shaft have different signs.

20. The drive system according to claim 4, wherein the first drive wheel is adjacent to the second drive wheel.

* * * * *